US011694537B2

(12) United States Patent
Liu et al.

(10) Patent No.: US 11,694,537 B2
(45) Date of Patent: Jul. 4, 2023

(54) WARNING DEVICE, WARNING SYSTEM FOR DETECTING WATER LEVEL IN DRAINAGE WELL

(71) Applicants: HONGFUJIN PRECISION ELECTRONICS (ZHENGZHOU) CO., LTD., Zhengzhou (CN); HON HAI PRECISION INDUSTRY CO., LTD., New Taipei (TW)

(72) Inventors: Hui-Sheng Liu, Zhengzhou (CN); Hai-Tao Xu, Zhengzhou (CN)

(73) Assignees: HONGFUJIN PRECISION ELECTRONICS (ZHENGZHOU) CO., LTD., Zhengzhou (CN); HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 17/555,668

(22) Filed: Dec. 20, 2021

(65) Prior Publication Data

US 2022/0309898 A1 Sep. 29, 2022

(30) Foreign Application Priority Data

Mar. 26, 2021 (CN) ..... 202120620607.5

(51) Int. Cl.

| | |
|---|---|
| ***G08B 21/18*** | (2006.01) |
| ***E02B 11/00*** | (2006.01) |
| ***E02B 11/02*** | (2006.01) |

(52) U.S. Cl.

CPC ..... *G08B 21/182* (2013.01); *E02B 11/005* (2013.01); *E02B 11/02* (2013.01); *G08B 21/185* (2013.01)

(58) Field of Classification Search

CPC ... G08B 21/182; G08B 21/185; E02B 11/005; E02B 11/02

USPC ..... 340/540

See application file for complete search history.

(56) References Cited

U.S. PATENT DOCUMENTS

| | | | | |
|---|---|---|---|---|
| 11,501,095 | B2 * | 11/2022 | Vogt | B01J 8/025 |
| 2003/0192379 | A1 * | 10/2003 | Ridenour | G01F 23/18 73/299 |
| 2004/0163806 | A1 * | 8/2004 | Hadley | E21B 47/047 166/250.03 |
| 2005/0132796 | A1 * | 6/2005 | Brookner | H04B 5/0056 73/290 R |
| 2006/0007008 | A1 * | 1/2006 | Kates | G01M 3/3245 340/618 |

(Continued)

*Primary Examiner* — Zhen Y Wu

(74) *Attorney, Agent, or Firm* — ScienBiziP, P.C.

(57) ABSTRACT

A warning device for detecting water level in drainage well includes at least one level sensor and a transceiver. The level sensor includes an antenna and a first processing unit connected to the antenna. The first processing unit controls the antenna to transmit a signal to the transceiver as to increased fluid levels. The transceiver includes a first communication module and a second processing unit, the first communication module receives the signal and the second processing unit obtains the signal from the first communication module and determines the location of the level sensor and its urgency according to whether the signal decays or disappears because of inundation by drainage fluid. The second processing unit further sends information of the target level sensor to a terminal device.

18 Claims, 3 Drawing Sheets

(56) References Cited

U.S. PATENT DOCUMENTS

| | | | | |
|---|---|---|---|---|
| 2006/0132351 | A1* | 6/2006 | Le Sesne | G01F 23/2845 342/124 |
| 2011/0199186 | A1* | 8/2011 | Han | G06K 19/07741 340/10.1 |
| 2011/0302995 | A1* | 12/2011 | Lebeau | G01F 1/696 73/40 |
| 2012/0126990 | A1* | 5/2012 | Chan | G08B 21/20 700/275 |
| 2013/0255373 | A1* | 10/2013 | So | G01F 23/284 73/290 V |
| 2014/0007672 | A1* | 1/2014 | Newton | G01F 23/292 73/290 R |
| 2014/0009302 | A1* | 1/2014 | Singer | G01F 23/2966 340/853.1 |
| 2014/0077944 | A1* | 3/2014 | Baskin | H04Q 9/00 340/539.1 |
| 2020/0404400 | A1* | 12/2020 | Vogt | G06K 7/10366 |
| 2022/0237393 | A1* | 7/2022 | Chung | G06K 19/0726 |

* cited by examiner

WARNING DEVICE, WARNING SYSTEM FOR DETECTING WATER LEVEL IN DRAINAGE WELL

CROSS-REFERENCE TO RELATED APPLICATIONS

This application claims priority to Chinese Patent Application No. 202120620607.5 filed on Mar. 26, 2021, in China Intellectual Property Administration, the contents of which are incorporated by reference herein.

FIELD

The present disclosure relates to urban planning, specifically a warning device and a warning system for detecting water level in drainage well.

BACKGROUND

In urban infrastructure, municipal road construction is constant. Drain inspection covers can be seen everywhere in the streets of the city. New urban construction pays attention to science and technology. The concept of a smart city is discussed more and more. In summer, thunderstorms test a city's urban drainage system, and sunken drain covers or theft of drain covers cause safety accidents. For example, when the level in drainage passages exceeds a limit value, cross flow of dirty water may occur and may even wash away the cover, resulting in potential safety hazards.

BRIEF DESCRIPTION OF THE DRAWINGS

Implementations of the present disclosure will now be described, by way of embodiments, with reference to the attached figures.

DETAILED DESCRIPTION

Figure 1:
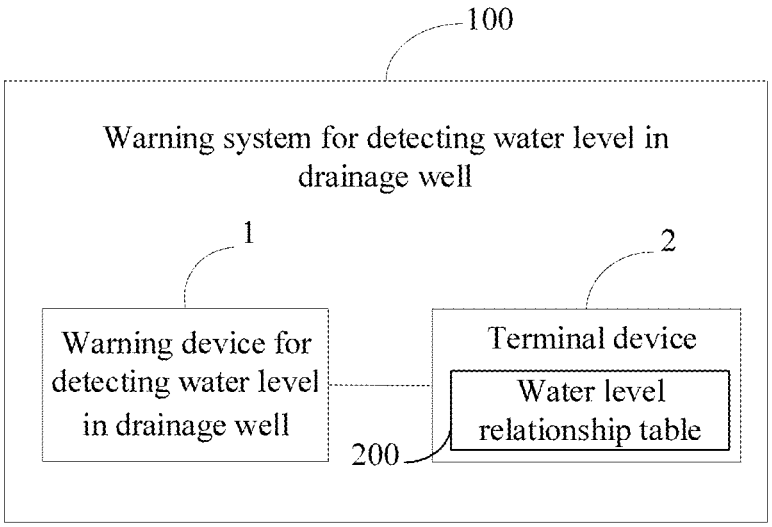
FIG. 1 is a schematic diagram of one embodiment of a warning system for detecting water level in drainage well according to the present disclosure.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure.

It should be noted that when an element is called "electrically connecting" another element, it can be directly connected to another element or connected to another element centered element by a third element. When an element is considered to be "electrically connected" to another element, it can be a contact connection, for example, a wire connection, or a non-contact connection, for example, a non-contact coupling.

The present disclosure, including the accompanying drawings, is illustrated by way of examples and not by way of limitation. Several definitions that apply throughout this disclosure will now be presented. It should be noted that references to "an" or "one" embodiment in this disclosure are not necessarily to the same embodiment, and such references mean "at least one".

The term "module", as used herein, refers to logic embodied in hardware or firmware, or to a collection of software instructions, written in a programming language, such as, Java, C, or assembly. One or more software instructions in the modules can be embedded in firmware, such as in an EPROM. The modules described herein can be implemented as either software and/or hardware modules and can be stored in any type of non-transitory computer-readable medium or other storage device. Some non-limiting examples of non-transitory computer-readable media include CDs, DVDs, BLU-RAY, flash memory, and hard disk drives. The term "comprising" means "including, but not necessarily limited to"; it specifically indicates open-ended inclusion or membership in a so-described combination, group, series, and the like.

Exemplary embodiments of the present disclosure will be described in relation to the accompanying drawings.

FIG. 1 illustrates a warning system 100 for detecting water level in drainage well. The warning system 100 includes a warning device 1 for detecting water level and a terminal device 2. The warning device 1 is communicated with the terminal device 2. The warning device 1 obtains water level information under a well cover and sends the water level information to the terminal device 2. The terminal device 2 determines whether the water level corresponding to the water level information exceeds a warning water level value, and issues alarm when determining that the water level exceeds the warning water level value.

Figure 2:
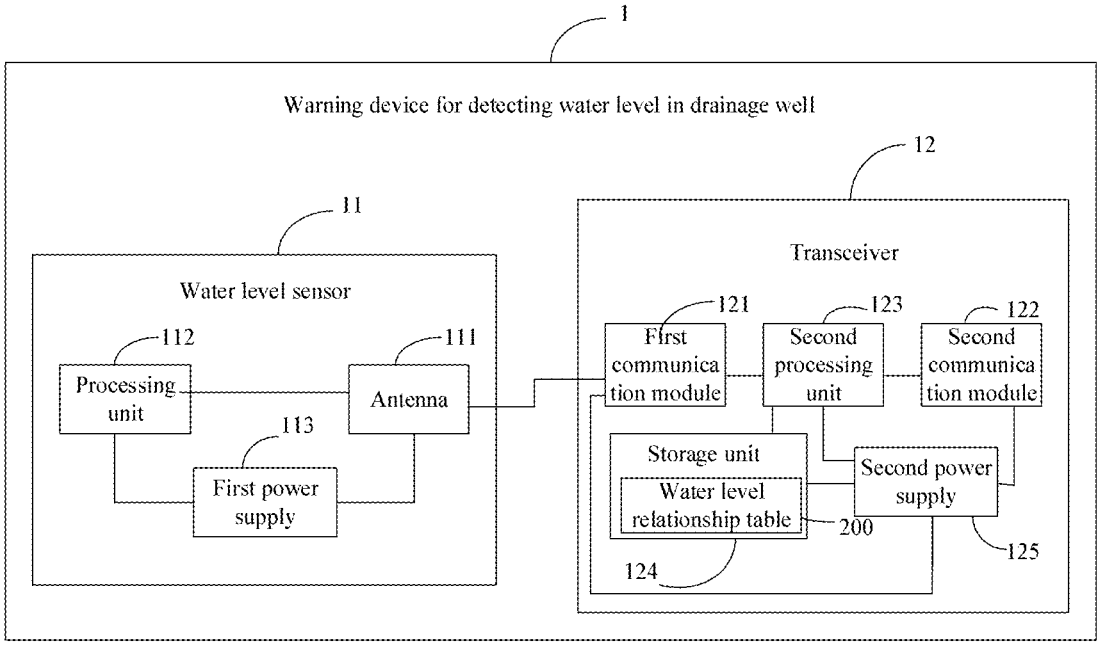
FIG. 2 is a schematic diagram of one embodiment of a warning device for detecting water level in drainage well according to the present disclosure.
Figure 3:
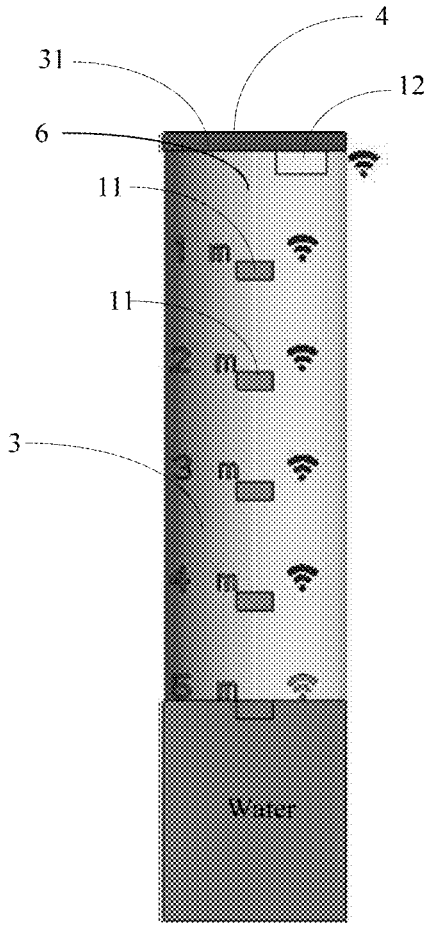
FIG. 3 is a schematic diagram of one embodiment of installing the warning device of FIG. 2 according to the present disclosure.

FIG. 2 illustrates the warning device 1. The warning device 1 includes at least one water level sensor 11 and a transceiver 12. Referring to FIG. 3, the warning device 1 is installed in a drainage well 3, and a well cover 4 covers an opening 31 of the drainage well 3. At least one preset water level is set in the drainage well 3. The preset water level can be set according to user's need. In one embodiment, any number of preset water levels can be set as required. In one embodiment, a position of the preset water level can also be selected according to user's need. For example, the positions of the preset water levels can be successively set at certain distances from the opening of the drainage well 3, or set at a certain distance from bottom of the drainage well 3, or other specific water level positions. In one embodiment, a spacing between each preset water level can be constant or at different distances. In one embodiment, each of the at least one water level sensor 11 is correspondingly set at one of the at least one preset water level. The at least one water level sensor 11 or a stacked arrangement of water level sensors 11 is set on a side wall of the drainage well 3 from the opening 31 of the drainage well 3, and each water level sensor 11 corresponds to one water level value. In one embodiment, the water level value of the water level sensor 11 refers to a distance value between the water level sensor 11 and the opening 31 of the drainage well 3. In one embodiment, the number of water level sensors 11 is 5, and the distance between each water level sensor 11 is 1 m.

In one embodiment, a thin rod 6 is installed on the side wall of the drainage well 3. The thin rod 6 is made of a material not liable to corrode, and the thin rod 6 is suitable for long life in water and is not affected by an electromagnetic signal. For example, the material of the thin rod 6 can be polytetrafluoroethylene (PTFE), carbon fiber, or copper oxide. It should be noted that the thin rod 6 can also be formed by extending from the opening 31 or the well cover 4 to the drainage well 3. The thin rod 6 can be installed on the side wall of the drainage well 3 by external connection element such as a screw. In one embodiment, the thin rod 6 can be embedded into the side wall of the drainage well 3. In one embodiment, at least one water level sensor 11 in the warning device 1 is arranged on the thin rod 6 at intervals. In one embodiment, when the thin rod 6 is made of metal, the at least one water level sensor 11 can be welded to the thin rod 6. In one embodiment, other existing installation methods for installing the at least one water level sensor 11 can also be used. In one embodiment, the transceiver 12 is installed on the well cover 4 covering the drainage well 3.

In one embodiment, the water level sensor 11 includes an antenna 111, a first processing unit 112, and a first power supply 113. The first processing unit 112 is connected to the antenna 111. The first power supply 113 is connected to the antenna 111 and the first processing unit. The first power supply 113 supplies power to the antenna 111 and the first processing unit 112.

In one embodiment, the first processing unit 112 controls the antenna 111 to transmit a communication signal to the transceiver 12. When the water level sensor 11 is under water, a radiation performance of the antenna 111 decreases, and the communication signal transmitted by the antenna 111 rapidly decays or disappears. In one embodiment, the antenna 111 may be a BLUETOOTH Low Energy (BLE) antenna. The first processing unit 112 controls the BLE antenna to send a signal to the transceiver 12. When the water level sensor 11 is under water, the radiation performance of the BLE antenna decreases, and the signal transmitted by the BLE antenna decays or disappears rapidly. In one embodiment, the BLE antenna has a long service life, and a spacing between each two water level sensors 11 or each two BLE antennas can be set to a minimum of 0.5 m, so as to accurately indicate the water level in the drainage well. In one embodiment, the antenna 111 may also be a Radio Frequency Identification (RFID) antenna, a WI-FI antenna or an Ultra Wide Band (UWB) antenna.

In one embodiment, the transceiver 12 receives or fails to receive the communication signal, determines a target water level sensor 11 according to the communication signal, and sends the information of the target water level sensor 11 to the terminal device 2.

In one embodiment, the transceiver 12 includes a first communication module 121, a second communication module 122, a second processing unit 123, a storage unit 124, and a second power supply 125. In one embodiment, the second processing unit 123 is connected to the first communication module 121, the second communication module 122, and the storage unit 124. The second power supply 125 is connected to the first communication module 121, the second communication module 122, the second processing unit 123, and the storage unit 124, and supplies power to the first communication module 121, the second communication module 122, the second processing unit 123, and the storage unit 124. In one embodiment, the first communication module 121 receives the communication signal sent by the water level sensor 11 in the warning device 1. The second processing unit 123 obtains the communication signal received by the first communication module 121 and determines the target water level sensor 11 according to whether the communication signal transmitted by each water level sensor 11 decays or disappears, and the communication signal transmitted by the target water level sensor 11 decays or disappears quickly. In one embodiment, the second processing unit 123 controls the second communication module 122 to send the information of the target water level sensor 11 to the terminal device 2.

In one embodiment, the first communication module 121 is a BLUETOOTH communication module. In one embodiment, in order to reduce product cost, the first communication module 121 includes a BLE antenna. The second communication module 122 includes a WI-FI communication module, a Lora communication module, a NBIOT communication module, a 4G communication module or a 5G communication module. In one embodiment, the storage unit 124 is used to store data and/or software code of the transceiver 12. The storage unit 124 may be an internal storage unit in the transceiver 12, such as a hard disk or memory in the transceiver 12. In another embodiment, the storage unit 124 may also be an external storage device in the transceiver 12, such as a plug-in hard disk, a smart media card (SMC), a secure digital (SD) card, and a flash card equipped on the transceiver 12. In one embodiment, the second processing unit 123 processes and stores the data received by the transceiver 12. In one embodiment, the second processing unit 123 may be a Central Processing Unit (CPU), other general-purpose processors, a Digital Signal Processor (DSP), an Application Specific Integrated Circuits (ASIC), and a Field Programmable Gate Arrays (FPGA) or other programmable logic devices, discrete gate or transistor logic devices, discrete hardware components, etc. In one embodiment, the second processing unit 123 may be any conventional processor or the like, and the second processing unit 123 may also be a control center of the transceiver 12, connecting various parts of the whole transceiver 12 using various interfaces and lines.

In one embodiment, the terminal device 2 determines the water level value corresponding to the target water level sensor 11 according to the information of the target water level sensor 11, and sends an alarm when determining that the water level value exceeds the warning water level value. In one embodiment, the terminal device 2 stores a water level relationship table 200. The water level relationship table 200 includes a relationship between different water level sensors 11 and different water level values. The terminal device 2 searches the water level relationship table 200 according to the target water level sensor 11, determines the water level value corresponding to the information of the target water level sensor 11, and sends the alarm when determining that the water level value exceeds the warning water level value. In one embodiment, the alarm can be at least one of text information, sound information, and image information. In one embodiment, the alarm includes information as to location of the drainage well 3 including the target water level sensor 11.

In one embodiment, the water level information of the drainage well is obtained and an alarm is issued when determining that the water level value exceeds the warning water level value, so as to solve a potential safety hazard.

In one embodiment, after determining the target water level sensor 11, the second processing unit 123 further determines the water level value corresponding to the target water level sensor 11 according to the water level relationship table 200 stored in the storage unit 124, generates an alarm when the water level value exceeds the warning water level value, and controls the second communication module 122 to send the water level value and the alarm to the terminal device 2.

In one embodiment, the terminal device 2 displays the water level value for the user to view. For example, the terminal device 2 displays the water level value on a display screen or on an application interface of the terminal device 2. In one embodiment, the terminal device 2 may be at least one of a mobile phone, a notebook computer, a computer, a tablet computer, a desktop computer and a server.

In one embodiment, the terminal device 2 further records the water level value and generates a water level report according to the recorded water level value. In one embodiment, the water level report can be a text report or a chart report.

The exemplary embodiments shown and described above are only examples. Even though numerous characteristics and advantages of the present disclosure have been set forth in the foregoing description, together with details of the structure and function of the present disclosure, the disclosure is illustrative only, and changes may be made in the detail, including in matters of shape, size, and arrangement of the parts within the principles of the present disclosure, up to and including the full extent established by the broad general meaning of the terms used in the claims.

What is claimed is:

1. A warning device for detecting water level in drainage well comprising:

at least one water level sensor corresponding to at least one preset water level, and each of the at least one water level sensor corresponding to one of preset water level values in the drainage well; and a transceiver, wherein each of the at least one water level sensor comprises an antenna and a first processing unit, the first processing unit is connected to the antenna, the first processing unit controls the antenna to transmit a communication signal to the transceiver, the transceiver comprises a first communication module and a second processing unit, the first communication module is connected to the second processing unit, the first communication module receives the communication signal sent by the antenna, the second processing unit obtains the communication signal from the first communication module and determines a target water level sensor under water according to a determination result indicating that the communication signal is decaying, and searches a water level relationship table according to the target water level sensor, and determines a water level value corresponding to the target water level sensor, and sends at least one of the water level value and an information of the target water level sensor to a terminal device.

2. The warning device for detecting water level in drainage well according to claim 1, wherein the at least one preset water level of the drainage well is successively set at a certain distance from an opening of the drainage well, or set at a certain distance from a bottom of the drainage well.

3. The warning device for detecting water level in drainage well according to claim 2, wherein the at least one water level sensor is configured to be set on a side wall of the drainage well.

4. The warning device for detecting water level in drainage well according to claim 1, wherein the water level value of the at least one water level sensor refers to a distance between the at least one water level sensor and an opening of the drainage well.

5. The warning device for detecting water level in drainage well according to claim 1, wherein a distance between two of the at least one water level sensors is 1 m.

6. The warning device for detecting water level in drainage well according to claim 1, wherein a thin rod is installed on a side wall of the drainage well, and the at least one water level sensor is arranged on the thin rod at intervals.

7. The warning device for detecting water level in drainage well according to claim 1, wherein the antenna is a BLUETOOTH Low Energy (BLE) antenna and the first communication module is a BLUETOOTH communication module.

8. The warning device for detecting water level in drainage well according to claim 1, wherein the transceiver comprises a second communication module, the second processing unit is connected to the second communication module, the second processing unit controls the second communication module to send the information of the target water level sensor to the terminal device.

9. The warning device for detecting water level in drainage well according to claim 8, wherein the second communication module is a Wi-Fi communication module, a Lora communication module, a NBIOT communication module, a 4G communication module or a 5G communication module.

10. The warning device for detecting water level in drainage well according to claim 1, wherein the at least one water level sensor further comprises a first power supply, the first power supply is connected to the antenna and the first processing unit, and the first power supply supplies power to the antenna and the first processing unit.

11. The warning device for detecting water level in drainage well according to claim 1, the transceiver further comprises a second power supply, and the second power supply is connected to the first communication module and the second processing unit, and the second power supply supplies power to the first communication module and the second processing unit.

12. The warning device for detecting water level in drainage well according to claim 1, wherein the second processing unit further generates an alarm when the water level value exceeds a warning water level value, and sends the water level value and the alarm to the terminal device.

13. The warning device for detecting water level in drainage well according to claim 1, wherein the transceiver is configured to be installed on a well cover covering the drainage well.

14. A warning system for detecting water level in drainage well comprising:

at least one water level sensor corresponding to at least one preset water level, and the at least one preset water level being set in the drainage well, and each of the at least one water level sensor corresponding to a water level value;

a transceiver, wherein each of the at least one water level sensor comprises an antenna and a first processing unit, the first processing unit is connected to the antenna, the first processing unit controls the antenna to transmit a communication signal to the transceiver, the transceiver comprises a first communication module and a second processing unit, the first communication module is connected to the second processing unit, the first communication module receives the communication signal sent by the antenna, the second processing unit obtains the communication signal from the first communication module and determines a target water level sensor under water according to a determination result indicating that the communication signal is decaying, and searches a water level relationship table according to the target water level sensor, and determines the water level value corresponding to the target water level sensor, and sends at least one of the water level value and an information of the target water level sensor; and a terminal device configured to determine the water level value corresponding to the target water level sensor according to the information of the target water level sensor, and send an alarm when determining that the water level value exceeds a warning water level value.

15. The warning system for detecting water level in drainage well according to claim 14, wherein the terminal device further displays the water level value.

16. The warning system for detecting water level in drainage well according to claim 14, wherein the terminal device further records the water level value and generates a water level report according to the recorded water level value.

17. The warning system for detecting water level in drainage well according to claim 16, wherein the water level report is at least one of a text report and a chart report.

18. The warning system for detecting water level in drainage well according to claim 14, wherein the alarm can be at least one of text information, sound information and image information.

* * * * *